US007800467B2

(12) United States Patent
Hoffmann

(10) Patent No.: US 7,800,467 B2
(45) Date of Patent: Sep. 21, 2010

(54) ELECTRICAL SWITCH ELEMENT, IN PARTICULAR A RELAY, FOR THE SIMULTANEOUS SWITCHING OF A PLURALITY OF CIRCUITS

(75) Inventor: Ralf Hoffmann, Berlin (DE)

(73) Assignee: Tyco Electronics AMP GmbH, Bensheim (DE)

( * ) Notice: Subject to any disclaimer, the term of this patent is extended or adjusted under 35 U.S.C. 154(b) by 182 days.

(21) Appl. No.: 11/924,905

(22) Filed: Oct. 26, 2007

(65) Prior Publication Data

US 2008/0110735 A1 May 15, 2008

(30) Foreign Application Priority Data

Nov. 14, 2006 (DE) ..... 10 2006 053 840

(51) Int. Cl.
*H01H 67/02* (2006.01)

(52) U.S. Cl. ..... 335/128; 335/78; 335/124

(58) Field of Classification Search ..... 335/78–86, 335/124, 128–131, 202
See application file for complete search history.

(56) References Cited

U.S. PATENT DOCUMENTS

| | | | | |
|---|---|---|---|---|
| 4,393,359 | A * | 7/1983 | Schreiner et al. | 335/128 |
| 5,617,066 | A * | 4/1997 | Dittmann et al. | 335/78 |
| 7,061,350 | B2 * | 6/2006 | Schneider et al. | 335/78 |
| 7,372,350 | B2 * | 5/2008 | Chida et al. | 335/128 |
| 7,474,181 | B2 * | 1/2009 | Takeda et al. | 335/78 |

FOREIGN PATENT DOCUMENTS

| | | | |
|---|---|---|---|
| DE | 19715261 | C1 | 4/1997 |
| DE | 44 17 157 | C2 | 6/2000 |
| DE | 102004054799 | A1 | 6/2005 |
| EP | 1 600 992 | A1 | 11/2005 |
| FR | 934.239 | | 5/1948 |
| FR | 1.402.000 | | 5/1965 |
| FR | 1438558 | A | 5/1966 |
| FR | 1.585.198 | | 1/1970 |
| GB | 640755 | A | 7/1950 |

* cited by examiner

*Primary Examiner*—Elvin G Enad
*Assistant Examiner*—Bernard Rojas
(74) *Attorney, Agent, or Firm*—Barley Snyder LLC

(57) ABSTRACT

An electrical switch element for a relay includes a base, a compensating element, and an actuating device. The base is provided with fixed contacts. The compensating element includes first and second switch contact carriers provided with switch contacts that correspond to the fixed contacts. The first and second switch contact carriers are connected by a rigid body joint arranged there between such that the first and second switch contact carriers are pivotable about a pivot axis. The rigid body joint has a support surface. The actuating device is in contact with the support surface. The actuating device applies a switching force to the support surface to cause the first and second switch contact carriers to pivot about the pivot axis to move the switch contacts into or out of electrical contact with the fixed contacts.

11 Claims, 6 Drawing Sheets

ELECTRICAL SWITCH ELEMENT, IN PARTICULAR A RELAY, FOR THE SIMULTANEOUS SWITCHING OF A PLURALITY OF CIRCUITS

CROSS-REFERENCE TO RELATED APPLICATIONS

This application claims the benefit of the filing date under 35 U.S.C. §119(a)-(d) of German Patent Application No. 10 2006 053 840.4, filed Nov. 14, 2006.

FIELD OF THE INVENTION

The invention relates an electrical switch element for a relay comprising a base, a compensating element, and an actuating device wherein the compensating element includes first and second switch contact carriers provided with switch contacts that correspond to fixed contacts, and the first and second switch contact carriers are connected by a rigid body joint arranged there between such that the first and second switch contact carriers are pivotable about a pivot axis to move the switch contacts into or out of electrical contact with the fixed contacts.

BACKGROUND

Electrical switch elements for the simultaneous switching of a plurality of circuits typically comprise an actuating device and a compensating element connected at a support surface to the actuating device, which has switch contact carriers that are movable against each other on which a pair of switch contacts respectively is arranged. This type of construction of electrical switch elements is known, for example, in the case of relays. In the case of relays, a coil-armature combination is usually used as the activating device, in which the armature is moved by a magnetic force brought about by the coil. This switching movement is transferred to the compensating element, so that switch contacts are brought into or out of contact with fixed contacts corresponding thereto. The fixed contacts are, for example, connected in pairs respectively to a circuit. The pairs of switch contacts, which are, for example, electrically connected, make or break these circuits substantially simultaneously via the switching movement. In a contact position with the fixed contacts, the compensating element aligns the switch contacts with the corresponding fixed contacts. In this way, a misalignment of the switch contacts with the fixed contacts due to variations in the heights of the fixed contacts caused, for example, by production tolerances or deposits, can be compensated.

A known relay of the type is described, for example, in EP 1 600 992 A1. A disadvantage of this relay is that a contact force, with which the switch contacts press against the fixed contacts in the contact position, can vary between the switch contacts. Thus, the electrical current can vary between the switch contacts and the fixed contacts, which has negative effects, particularly when switching large currents.

SUMMARY

It is therefore an object of the present invention is to provide an electrical switch element for the switching of a plurality of circuits, wherein a contact force on the switch contacts is distributed almost evenly.

This and other objects are achieved by an electrical switch element for a relay comprising a base, a compensating element, and an actuating device. The base is provided with fixed contacts. The compensating element includes first and second switch contact carriers provided with switch contacts that correspond to the fixed contacts. The first and second switch contact carriers are connected by a rigid body joint arranged there between such that the first and second switch contact carriers are pivotable about a pivot axis. The rigid body joint has a support surface. The actuating device is in contact with the support surface. The actuating device applies a switching force to the support surface to cause the first and second switch contact carriers to pivot about the pivot axis to move the switch contacts into or out of electrical contact with the fixed contacts.

DETAILED DESCRIPTION OF THE EMBODIMENT(S)

Figure 1:
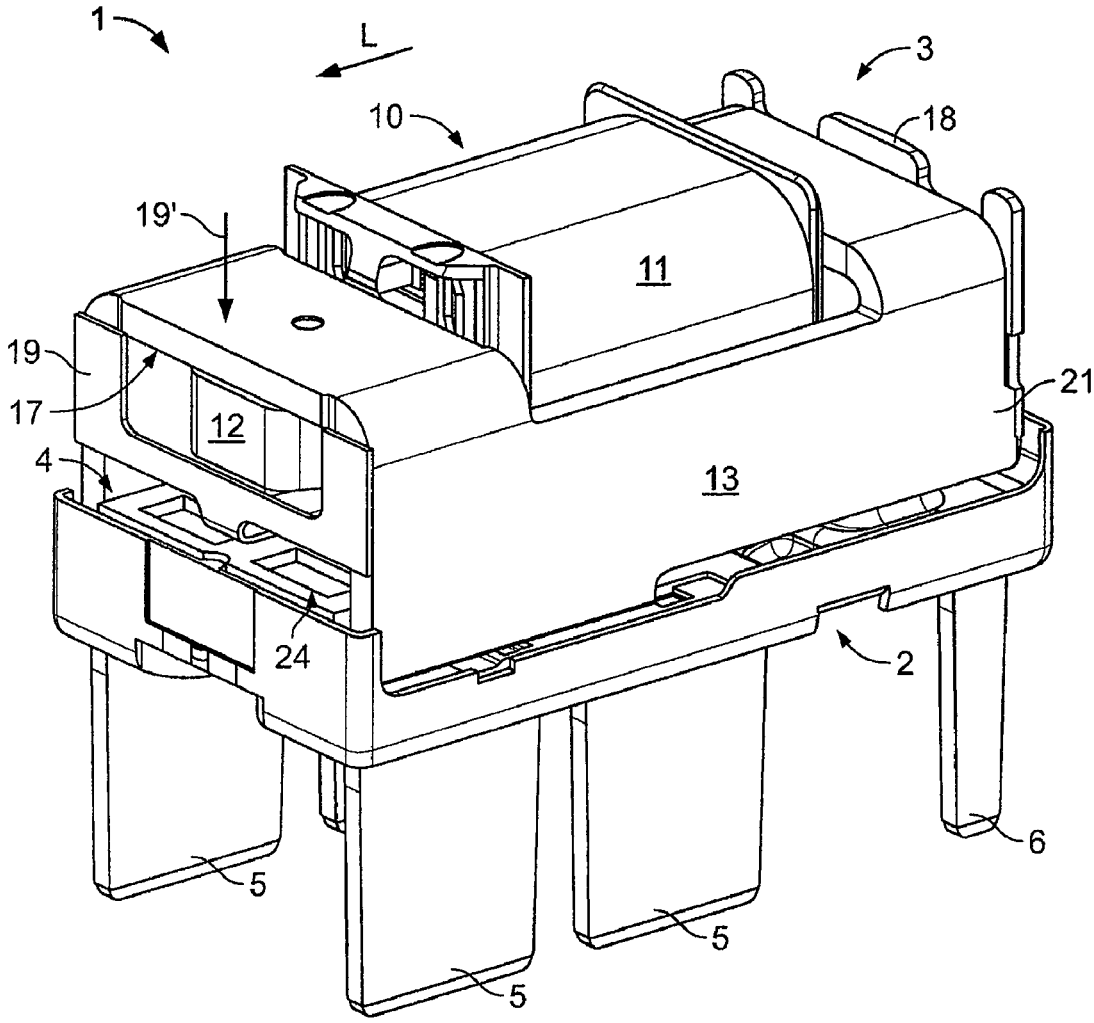
FIG. 1 is a schematic perspective view of an embodiment of an electrical switch element according to the present invention.
Figure 2:
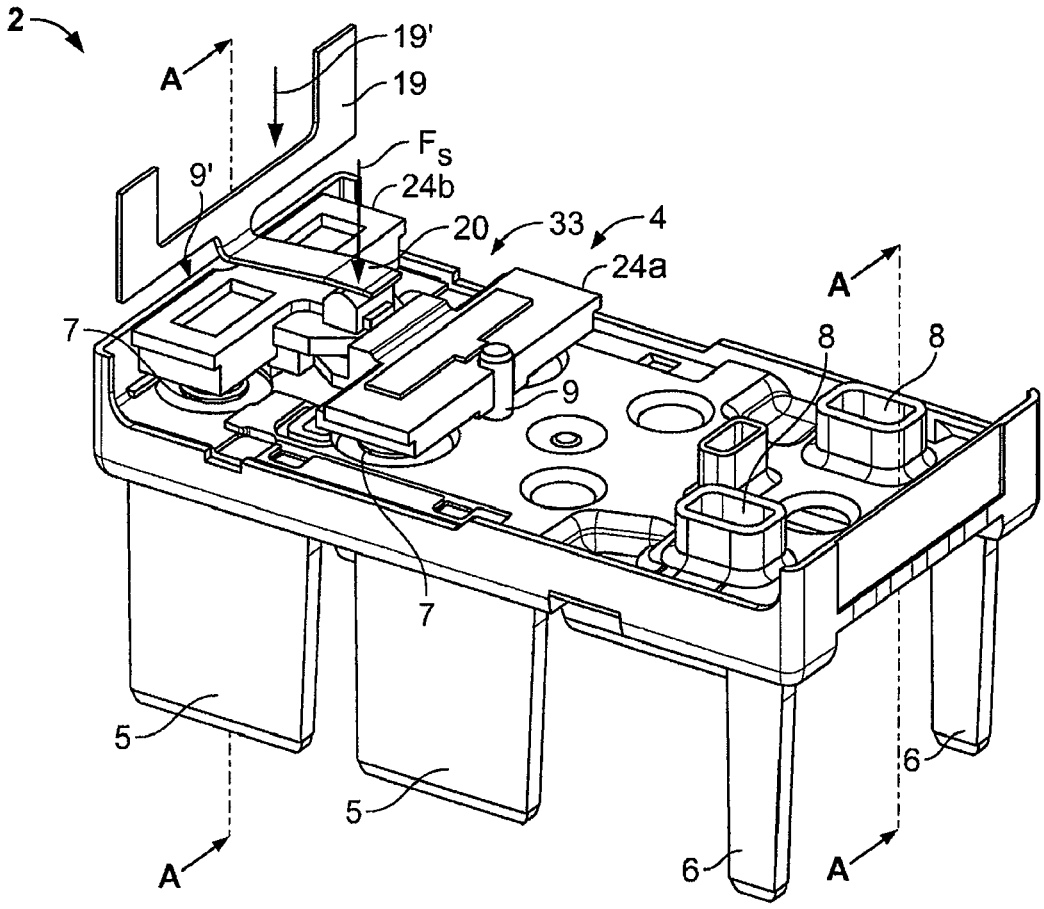
FIG. 2 is a schematic perspective view of the electrical switch element of FIG. 1 shown without a portion of an actuating device.

FIG. 1 shows an electrical switch element 1, such as a relay, according to an embodiment of the present invention. A plurality of circuits can be switched with the electrical switch element 1 according to the embodiment of the present invention with the aid of an electrical control voltage. As shown on FIG. 1, the electrical switch element 1 comprises a base 2, an actuating device 3, and a compensating element 4. As shown in FIG. 2, the base 2 has a plurality of connecting contacts 5, 6 extending there from. The connecting contacts 5, 6 are, for example, pin contacts. The connecting contacts 5, 6 are manufactured from an electrically conductive material, such as copper. The connecting contacts 5, 6 are arranged substantially parallel to each other and have a substantially rectangular cross section. The connecting contacts 5, 6 are configured, for example, to be welded or inserted into sockets, such as provided inside a switchbox of a motor vehicle. The connecting contacts 6 have a smaller cross section than the connecting contacts 5 and serve in particular to feed the control voltage, which the electrical switch element 1 switches. The connecting contacts 5 provided with the larger cross section are provided to connect the circuits to be switched. The cross section of the connecting contacts 5 is constructed larger than the cross section of the connecting contacts 6 in order to be suitable also for larger currents.

Figure 3:
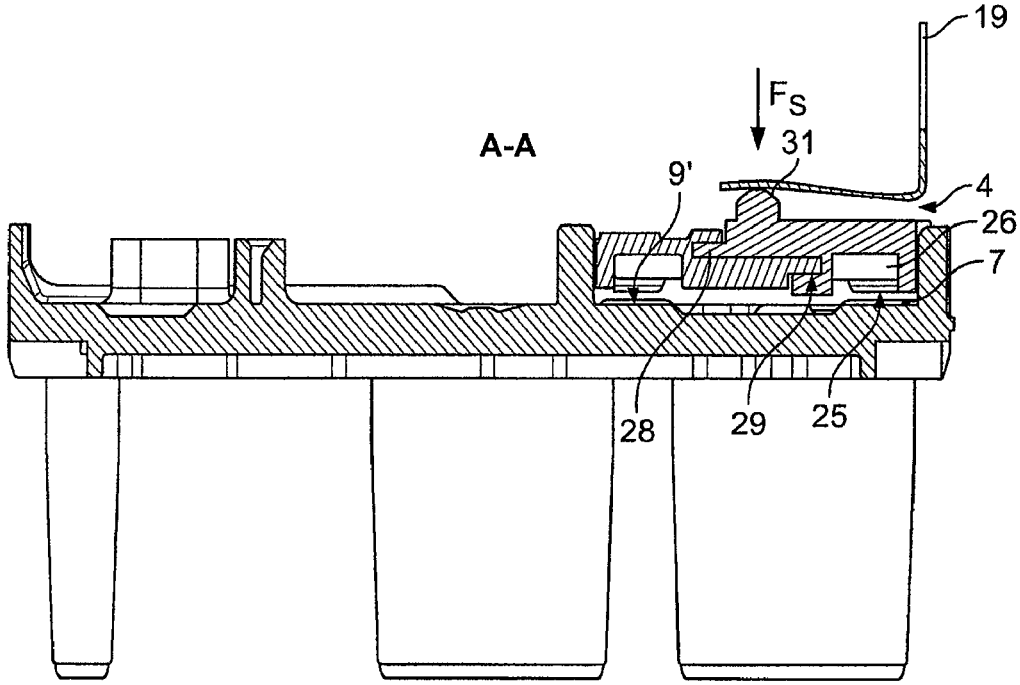
FIG. 3 is a sectional view of the electrical switch element of FIG. 2 taken along plane A-A.

As shown in FIG. 2, fixed contacts 7 are provided on an upper surface of the base 2 substantially above the connecting contacts 5. Each of the fixed contacts 7 is electrically conductively connected to one of the connecting contacts 5. The fixed contacts 7 have a substantially circular flat contact surface 9', as shown in FIG. 3. The fixed contacts 7 are manufactured from an electrically conductive material, such as copper. As shown in FIG. 2, the base 2 has a plurality of recessed openings 8 configured to receive the actuating device 3. At least a plurality of the recessed openings 8 is formed substantially above the connecting contacts 6. Substantially cylindrical pins 9 protrude upwards from the base 2. The pins 9 are substantially rigid and are configured as guide elements that position and fix the compensating element 4, which is arranged above the fixed contacts 7.

Figure 4:
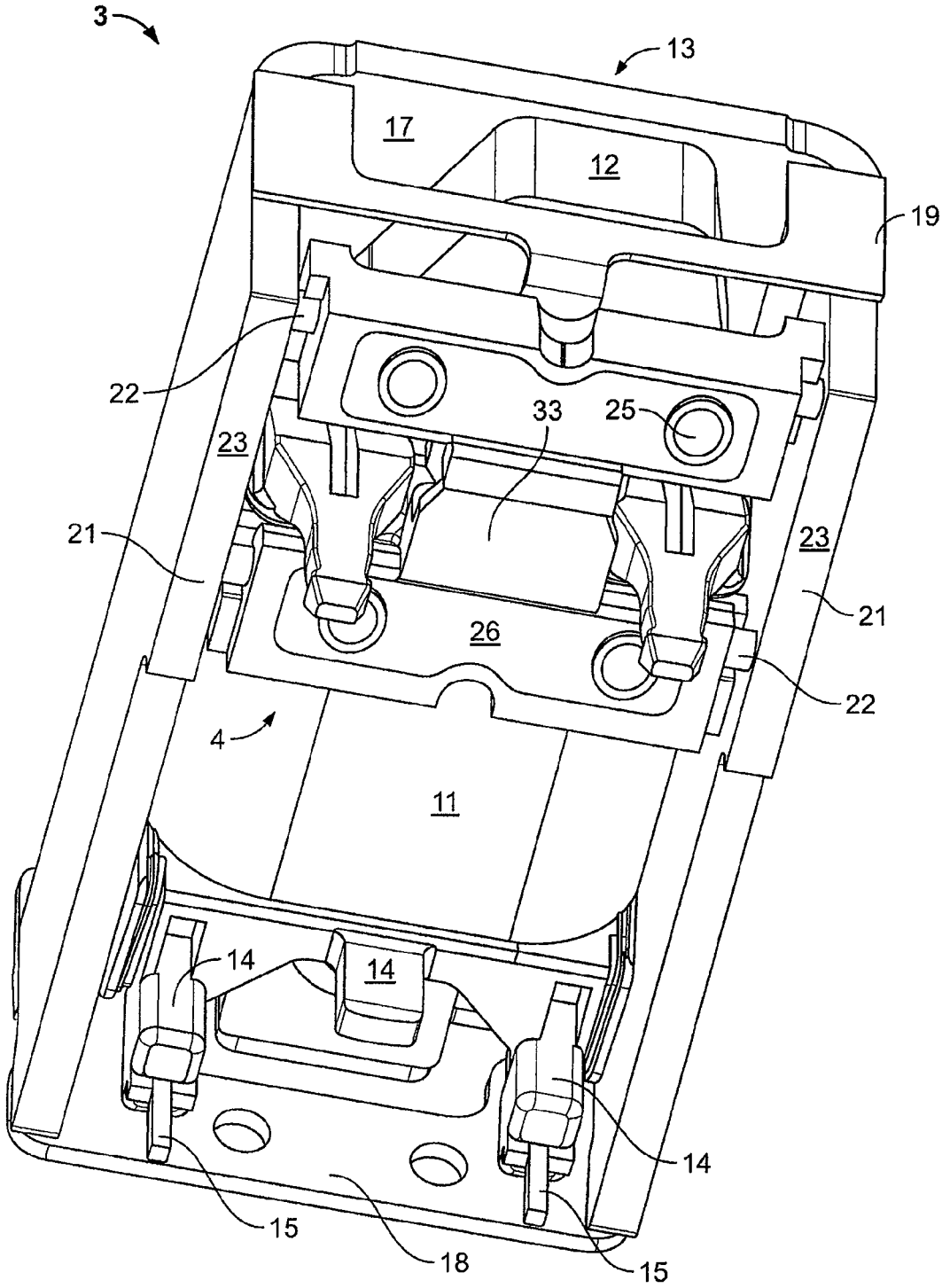
FIG. 4 is a schematic perspective view of the actuating device and a compensating element of the electrical switch element of FIG. 1 shown from below.

As shown in FIG. 1, the actuating device 3, which can be activated electromagnetically, is arranged substantially above the base 2. The actuating device 3 comprises an electromagnet 10. The electromagnet 10 includes a coil 11 with a core 12 passing there through. As shown in FIG. 4, the electromagnet 10 has retaining pins 14, which are configured to be inserted into the recessed openings 8 of the base 2 and thereby fix the electromagnet 10 to the base 2. Connecting contacts 15 of the electromagnet 10 are configured to be inserted into the recessed openings 8 formed substantially above the connecting contacts 6. The connecting contacts 15 electrically connect the coil 11 with the connecting contacts 6 of the base 2 through a mating contact (not shown) in the recessed openings 8, so that a control voltage applied to the connecting contacts 6 flows through the coil 11, and the electromagnet 10 creates a magnetic field.

As shown in FIG. 1, a substantially U-shaped armature 13 of the actuating device 3 is arranged above the base 2 movable relative to the electromagnet 10. The armature 13 has an opening through which the coil 11 of the electromagnet 10 protrudes partially upwards. A base surface 17 of the armature 13 extends in a longitudinal direction L on both sides of the opening and is arranged above the core 12. The armature 13 is pivotal with respect to the base 2 via a return spring 18 arranged at one end of the armature 13 opposite the compensating element 4. At the other end of the armature 13, opposite the return spring 18, a spring contact 19 is arranged on the armature 13. The spring contact 19 may be made, for example, from a substantially resilient flat material. The spring contact 19 has a substantially U-shaped end, which is rigidly connected to sides of the armature 13, for example, by gluing or soldering. The spring contact 19 has leaf spring and torsion spring portions and is installed preloaded. For example, the spring contact 19 may be bent approximately at right angles in the center and ends opposite the substantially U-shaped end between the core 12 and the base 2. As shown in FIG. 2, a free resilient end 20 of the spring contact 19 is configured to press with a switching force $F_s$ against the compensating element 4. When the electromagnet 10 is activated by the control voltage, a magnetic field is created in the core 12, which attracts the base surface 17 of the armature 13. The actuating device 3 creates a switching movement 19' in the armature 13, activated by a control voltage, towards the base 2 as a result.

As shown in FIG. 4, the armature 13 has sides 21 provided with raised lugs 22. The raised lugs 22 are located opposite each other and protruding inwards from an interior of the sides 21. The lugs 22 are configured to support the compensating element 4 and are positioned such that the compensating element 4 is pressed against the lugs 22 by the preloaded spring contact 19 in a direction of the switching movement 19'. The sides 21 of the armature 13 have ends 23 extending in the direction of the switching movement 19'. The ends 23 serve as stops and engage the base 2 during the switching movement 19' in order to limit the lift of the armature 13. Corresponding counter-surfaces can be constructed on the base 2, which counter the wear to the base 2 caused by the ends 23.

Figure 5:
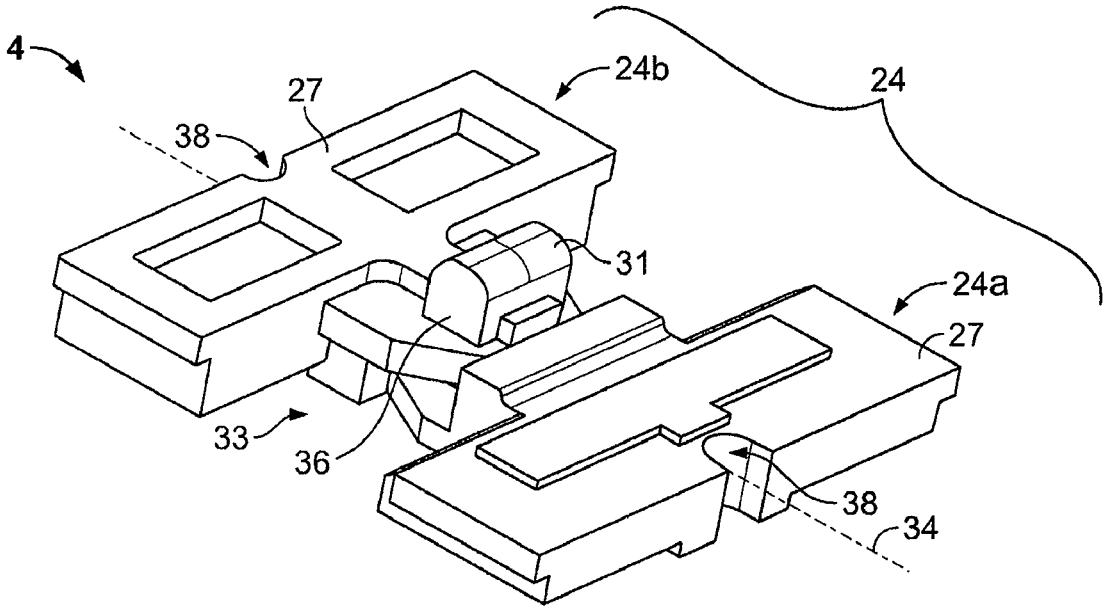
FIG. 5 is a schematic perspective view of a compensating element of the electrical switch element of FIG. 1 shown from above.
Figure 6:
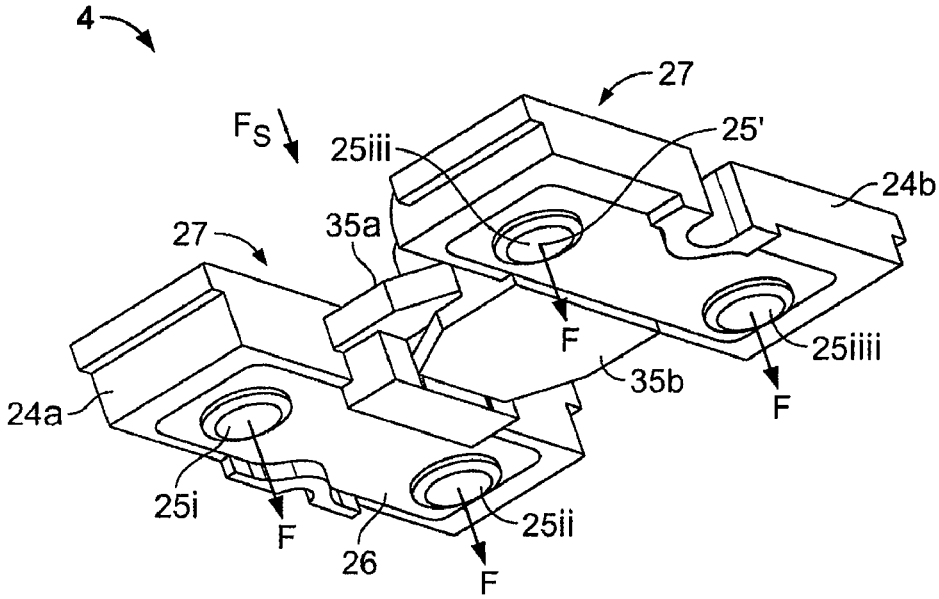
FIG. 6 is a schematic perspective view of the compensating element of the electrical switch element of FIG. 1 shown from below.
Figure 7:
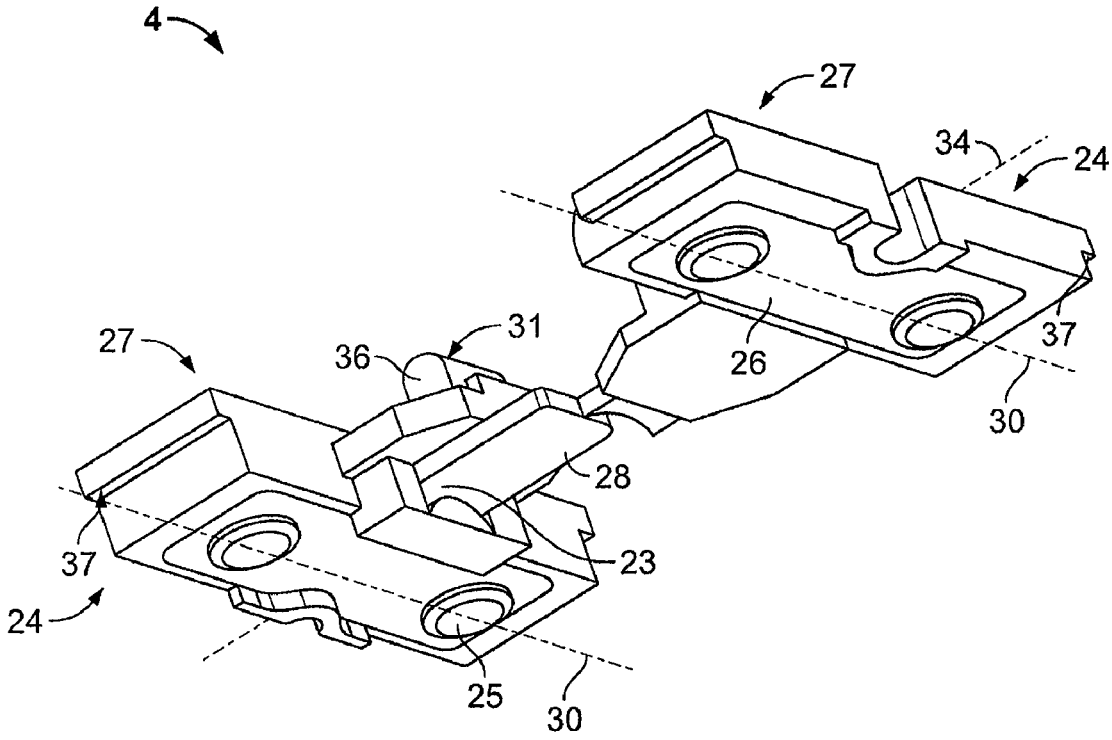
FIG. 7 is a schematic exploded view of the compensating element of the electrical switch element of FIG. 1 shown from below.

As shown in FIG. 1, the compensating element 4 is moveably arranged between the base 2 and the actuating device 3 and extends substantially parallel to the base 2. As shown in FIG. 5, the compensating element 4 comprises a switch contact carrier 24 consisting of a first switch contact carrier **24*a* and a second switch contact carrier 24*b* configured to be moved towards each other. As shown in FIG. 4, switch contacts 25 are arranged on the switch contact carriers 24. As shown in FIG. 6, in the illustrated embodiment, the switch contacts 25 consist of the switch contacts 25*i*, 25*ii*, 25*iii*, and 25*iiii*. The first switch contact carrier 24*a* is provided with the switch contacts 25*i*, 25*ii*, and the second switch contact carrier 24*b* is provided with the switch contacts 25*iii* and 25*iiii*. The switch contacts 25 are configured substantially similar to the fixed contacts 7 and have a substantially round, planar contact surface 25'. The switch contacts 25 of each of the switch contact carriers 24 are electrically connected by an electrically conductive plate member 26 on which the switch contacts 25 are arranged. The plate member 26 is manufactured from an electrically conductive material, such as copper. The plate members 26 have a plate thickness substantially greater than 0.5 mm, so that the plate members are capable of conducting large currents. The plate members 26 are each arranged on an insulating member 27. As shown in FIG. 7, bearing surfaces 37 are constructed on ends of the first and second switch contact carriers 24*a*, 24*b***.

Figure 9:
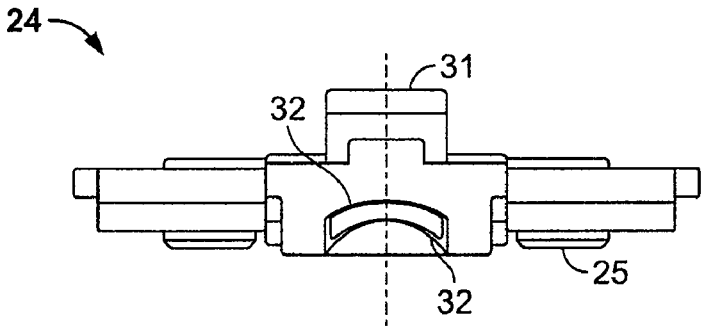
FIG. 9 is a sectional view of the compensating element of FIG. 8 taken along sectional line B-B.
Figure 8:
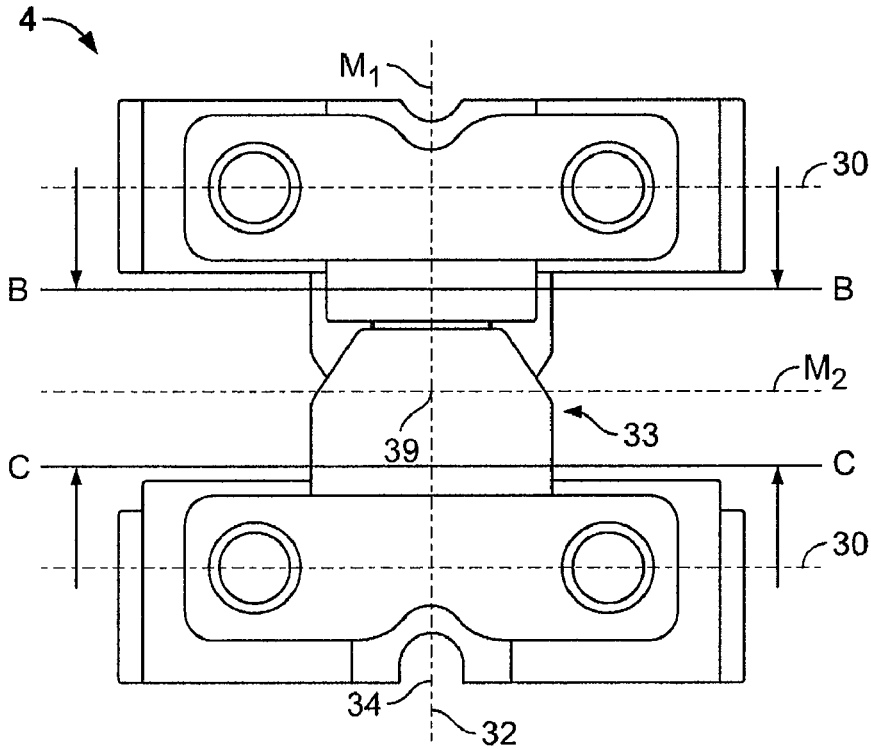
FIG. 8 is a schematic plan view of the compensating element of the electrical switch element of FIG. 1 shown from below.
Figure 10:
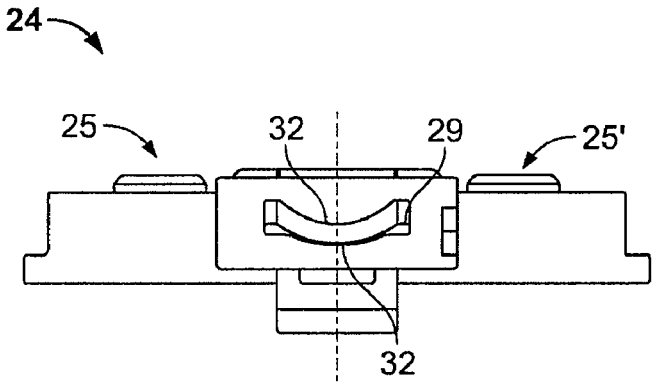
FIG. 10 is a sectional view of the compensating element of FIG. 8 taken along sectional line C-C.

As shown in FIG. 6, the insulating member 27 may be made out of an electrically non-conductive material, such as plastic, and may be formed by injection molded parts. As shown in FIG. 3, the insulating members 27 are provided with protrusions 28 and cavities 29. The protrusions 28 and the cavities 29 are configured to substantially complement each other and engage with one another when the first switch contact carrier **24*a* and the second switch contact carrier 24*b* are coupled to each other. In the illustrated embodiment, the protrusions 28 and the cavities 29 extend substantially transverse to a longitudinal axis 30 of the first switch contact carrier 24*a* and the second switch contact carrier 24*b*, which runs through central points of the switch contact surfaces 25', as shown in FIG. 8. As shown in FIGS. 9-10, the protrusions 28 and the cavities 29 have a substantially spherically construction on upper and lower faces thereof that forms a radius. The different radii are configured in relation to each other so that they get substantially smaller towards the switching force $F_s$ introduced by the spring contact 19, as shown in FIG. 2. In other words, the respective surface of the protrusion 28 or the cavity 29, which is located above, has a larger radius than the surface of the protrusion 28 or the cavity 29** with which it is in contact and which is located below.

As shown in FIG. 8, when the compensating element 4 is assembled, the first and second switch contact carriers **24*a*, 24*b* are engaged with each other along a pivot axis 34, which runs along a first central axis $M_1$. Due to the different radii, the switch contact carriers 24, which engage with each other, only touch each other towards the switching force $F_s$ on contact lines 32, which run transverse to the switching force $F_s$, as shown in FIGS. 9-10. The contact lines 32 of the protrusions 28 and the cavities 29** run in the projection from below in FIG.

8 along the first central axis $M_1$ between the switch contacts 25, which runs transverse to the longitudinal axis 30 of the switch contact carrier 24. As shown in FIG. 8, the first and second switch contact carriers 24*a*, 24*b* together form a rigid body joint 33 through the protrusions 28 and the cavities 29 constructed in this way. Due to the substantially spherical construction of the protrusions 28 and the cavities 29, the first and second switch contact carriers 24*a*, 24*b* can pivot against each other in a restricted region along the pivot axis 34.

As shown in FIG. 8, the assembled first and second switch contact carriers 24*a*, 24*b* are connected to each other substantially rigidly by the protrusions 28 and the cavities 29 engaging each other in relation to a rotation or translation substantially transverse to the pivot axis 34. The first and second switch contact carriers 24*a*, 24*b* can thereby only be deflected in relation to each other about the pivot axis 34. The rigid body joint 33 is therefore a swivel joint with a single degree of freedom, namely the pivotal movement about the pivot axis 34. The protrusions 28 and the cavities 29 are connecting members 35*a*, 35*b*, which form the rigid body joint 33 in the assembled state. The connecting members 35*a*, 35*b* and the insulating members 27 may be, for example, constructed as production parts and manufactured in injection molding processes.

As shown in FIGS. 5 and 8, the first and second switch contact carriers 24*a*, 24*b* each semi-circular groove 38 that extends substantially transverse to the first central axis $M_1$. The grooves 38 have a radius corresponding substantially to a radius of the cylindrical pins 9 assembled compensating element 4 is arranged so that the grooves 38 engage with the cylindrical pins 9. Because the grooves 38 are arranged along the pivot axis 34 of the compensating element 4, the grooves 38 prevent the assembled first and second switch contact carriers 24*a*, 24*b* from being pulled apart.

As shown in FIGS. 5-6, a support member 36 that extends from the connecting member 35*a* is a direction opposite from the switching movement 19'. As shown in FIGS. 5 and 8, an upper end of the support member 36 is configured to have a substantially spherically configuration along a second central axis $M_2$, which runs substantially parallel to the longitudinal axis 30 and extends substantially centrally between the switch contacts 25 of the first and second switch contact carriers 24*a*, 24*b*. The spring contact 19 presses with line contact along the second central axis $M_2$ onto the support member 36 to form a support surface 31, as shown in FIG. 3. Due to the contact along the second central axis $M_2$ at the support member 36 and the contact along the first central axis $M_1$ on the rigid body joint 33, the switching force $F_s$ acts in relation to the lever conditions to the switch contacts 25 at a point of intersection 39 of the first and second central axes $M_1$, $M_2$, as shown in FIG. 8.

The operation of the electrical switch element 1 will now be described in greater detail. FIGS. 1-4 show the switch contacts 25 positioned away from the fixed contacts 7 in an open position. In the open position, a preloading force is exerted onto the compensating element 4 by the spring contact 19 arranged in a preloaded manner between the armature 13 and the support member 36. The bearing surfaces 37 of the first and second switch contact carriers 24*a*, 24*b*, which rest on the lugs 22 of the armature 13, are thereby pressed against the lugs 22, as shown in FIG. 4. When the electrical switch element 1 is activated, a control voltage is applied that causes the armature 13 of the activating device 3 to carry out the switching movement 19', which moves the switch contacts 25 of the compensating element 4 into electrical contact with the fixed contacts 7.

The switch contacts 25 are pressed against the fixed contacts 7 by the switching force $F_s$ brought about by the actuating device 3. The switching force $F_s$ acting on the support surface 31 creates a movement at the first switch contact carrier 24*a*, which has the first and second switch contacts 25*i*, 25*ii*. The first switch contact carrier 24*a* tips, for example, the second switch contact 25*ii* into a contact position with the respective fixed contact 7. Because the first and second switch contact carriers 24*a*, 24*b* are rigidly connected by the rigid body joint 33 and extend substantially transverse to the pivot axis 34, the switching force $F_s$, which is still effective, creates a movement about the first central axis $M_1$ in the second switch contact carrier 24*b* having the third and fourth switch contacts 25*iii*, 25*iiii*. The second switch contact carrier 24*b* is then pressed downward by a movement about the second central axis $M_2$ so that, for example, the third switch contact 25*iii* is moved into a contact position with the respective fixed contact 7. In the contact position the switch contacts 25 of the switch contact carrier 24 are thereby in electrical contact with at least two of the fixed contacts 7.

Any height differences of the fixed contacts 7 caused by production tolerances or material deposits during operation are thereby balanced out variably through the functionality of the compensating element 4. Additionally, because the compensating element 4 is configured as a rigid body on the line of force between the support surface 31 and the switch contacts 25 and the introduction of force takes place via the point of intersection 39, the switching force $F_s$ is evenly distributed across the switch contacts 25, and the switch contacts 25 are pressed with substantially the same contact force F against the assigned fixed contacts 7. The armature 13 carries out an over-deviation, which distances the lugs 22 from the bearing surfaces 37, after the compensating element 4 has been moved into the contact position. The bearing surface 37 forms the only contact between the compensating element 4 and the actuating device 3 in the contact position of the electrical switch element 1, as a result.

When the electrical switch element 1 is deactivated, the return spring 18 restores the armature 13 to its initial position. As a result, the lugs 22 of the armature 13 move in a direction opposite to the switching movement 19' and strike against the bearing surfaces 37 of the compensating element 4, and the compensating element 4 moves in a direction opposite to the switching movement 19', so that the switch contacts 25 are moved away from the fixed contacts 7. Due to the lugs 22 surrounding the compensating element 4, a relatively great disengaging force can be exerted onto the compensating element 4 to pull the switch contacts 25 and the fixed contacts 7 apart. This is advantageous in instances where the fixed contacts 7 and the switch contacts 25 are welded together in the contact position, which can happen when switching large currents.

The solution according to the invention is simple in construction and has the advantage that the rigid body joint 33 does not absorb any force, which would displace the balance of forces between the switch contacts 25. A force introduced in the support surface 31 is thus transferred substantially evenly to the switch contacts 25. The electrical switch element 1 according to the invention thereby can compensate a misalignment of the fixed contacts 7 in relation to the switch contacts 25, because the rigid body joint 33 of the completely movable compensating element 4 movably connects the switch contact carriers 24 to each other. Additionally, force-absorbing flexible compressions on a line of force between the support surface 31 and the switch contact 25, which can influence the distribution of force on the switch contacts 25, can be avoided.

Further, because the connecting members 35*a*, 35*b* are each arranged on a separate one of the switch contact carriers 24 and form the rigid body joint 33, the electrical switch element 1 can be constructed especially compactly and with few component ports, since the connecting members 35*a*, 35*b* that form the rigid body joint 33 can be handled as one part with the switch contact carriers 24. Additionally, the permanent preloading of the compensating element 4 has the advantage that the contact force is built up quickly and evenly when the electrical switch element 1 is switched. This has the advantage that the contact force is not fully built up via an over-deviation of the armature 13, in contrast to the spring systems without preloading used in prior art, but rather only to about 10%. The influence of the tolerance of the over-deviation is therefore substantially lower in the present invention and an adjustment of the actuating device 3 to the compensating element 4 does not have to be performed during the assembly, for example. The position of the actuating device 3 in relation to the compensating element 4 can rather be determined by fixed amplitudes.

The foregoing illustrates some of the possibilities for practicing the invention. Many other embodiments are possible within the scope and spirit of the invention. For example, in the illustrated embodiment, the electrical switch element 1 is configured to simultaneously electrically connect the switch contacts 25 with the fixed contacts 7 through its activation. Alternatively, the electrical switch element 1 can be constructed such that the electrical switch element 1 is configured to simultaneously disconnect the switch contacts 25 from the fixed contacts 7 through its activation. It is, therefore, intended that the foregoing description be regarded as illustrative rather than limiting, and that the scope of the invention is given by the appended claims together with their full range of equivalents.

What is claimed is:

1. An electrical switch element for a relay, comprising:

a base provided with fixed contacts;

a compensating element having first and second switch contact carriers provided with switch contacts that correspond to the fixed contacts, the first and second switch contact carriers being connected by a rigid body joint arranged there between such that the first and second switch contact carriers are pivotable about a pivot axis, the rigid body joint having a support surface;

opposing complementary protrusions and cavities located on the switch contact carriers and extending substantially transverse to a longitudinal axis of the switch contact carriers; and an actuating device in contact with the support surface, the actuating device applying a switching force to the support surface to cause the first and second switch contact carriers to move about the pivot axis to pivot the switch contacts into or out of electrical contact with the fixed contacts.

2. The electrical switch element of claim 1, wherein the actuating device includes a contact spring, the contact spring having a free resilient end that engages the support surface.

3. The electrical switch element of claim 2, wherein the contact spring is actuated by an armature.

4. The electrical switch element of claim 3, wherein the first and second switch contact carriers have bearing surfaces supported by lugs extending from the armature.

5. The electrical switch element of claim 1, wherein the first switch contact carrier is pivotally connected to the rigid body joint and the second contact carrier is separately pivotally connected to the rigid body joint.

6. The electrical switch element of claim 1, wherein the pivot axis runs centrally between the switch contacts provided on the first and second switch contact carriers.

7. The electrical switch element of claim 1, wherein connecting members extend from the first and second switch contact carriers, the rigid body joint being formed by the engagement of the connecting members.

8. The electrical switch element of claim 1, wherein the compensating element is arranged between the base and the actuating device.

9. The electrical switch element of claim 1, wherein the compensating element extends substantially parallel to the base.

10. The electrical switch element of claim 1, wherein the first and second switch contact carriers are provided with grooves on sides opposite from the rigid body joint, the first and second switch contact carriers being supported by pins extending from the base and positioned in the grooves.

11. The electrical switch element of claim 1, wherein the first and second switch contact carriers extend substantially transverse to the pivot axis.

* * * * *